US005365116A

United States Patent [19]

Lohss

[11] Patent Number: 5,365,116

[45] Date of Patent: Nov. 15, 1994

[54] INCLINATION SWITCH

[75] Inventor: Kurt L. Lohss, Pentwater, Mich.

[73] Assignee: LDI Inc., Kentwood, Mich.

[21] Appl. No.: 35,737

[22] Filed: Mar. 23, 1993

[51] Int. Cl.[5] ..... H01H 35/02

[52] U.S. Cl. ..... 307/121; 200/61.52; 200/61.83; 200/61.45 R

[58] Field of Search ..... 200/61.45 R–61.53, 200/61.45 M, 61.83; 307/116, 119, 120, 121

[56] References Cited

U.S. PATENT DOCUMENTS

| | | | |
|---|---|---|---|
| 3,729,602 | 4/1973 | Myers | 200/61.52 |
| 3,894,250 | 7/1975 | Hager et al. | 307/309 |
| 4,001,185 | 1/1977 | Mitsui et al. | 200/61.45 R |
| 4,337,402 | 6/1982 | Nowakowski | 307/121 |
| 4,467,154 | 8/1984 | Hill | 200/61.45 R |
| 4,764,761 | 8/1988 | Magurie, III | 340/690 |
| 4,820,888 | 4/1989 | Shields | 200/61.45 M |
| 4,956,629 | 9/1990 | Chen | 340/429 |
| 5,010,893 | 4/1991 | Sholder | 200/61.45 R X |
| 5,136,126 | 8/1992 | Blair | 200/61.52 |

OTHER PUBLICATIONS

McNulty, Tom, "Understanding Power MOSFETs," *Harris Semiconductor APPNOTE, Harris Power MOSFETs*, No. 7244.1, May, 1992, pp. 13–3 through 13–6.

*Primary Examiner*—J. R. Scott

*Attorney, Agent, or Firm*—Price, Heneveld, Cooper, DeWitt & Litton

[57] ABSTRACT

An inclination responsive switch is provided for repetitively actuating and deactuating a high-current load, such as a low-voltage lamp in an automobile. A gravity responsive device produces a low-current output signal, which has a first state when the gravity responsive device is in a first inclination position and a second state when the device is in a second inclination position. A semiconductor switching device has a low-current input terminal connected with a low-current output of the gravity responsive device. The switching device amplifies the low-current electrical signal to produce a high-current electrical signal in order to supply high current to a load connected with the high-current output terminal of the switching device to actuate the load in one inclination position and terminates the high current to deactuate the load in the other inclination position.

29 Claims, 5 Drawing Sheets

FIG. 3
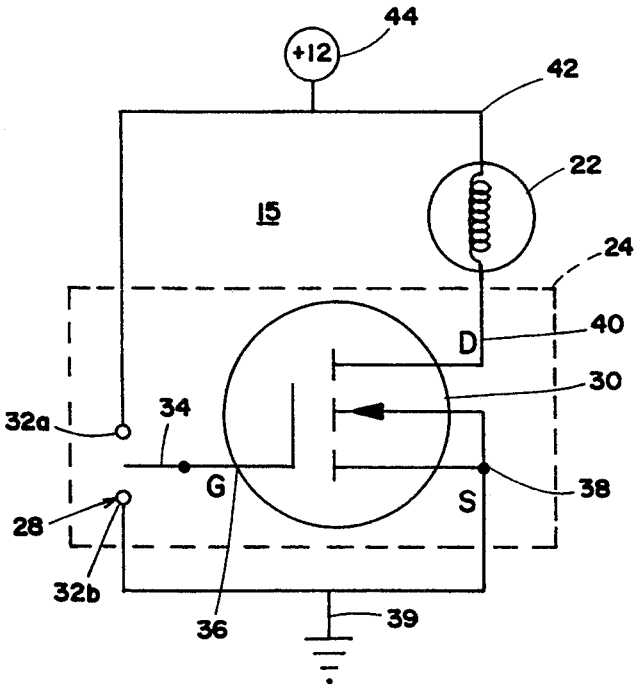
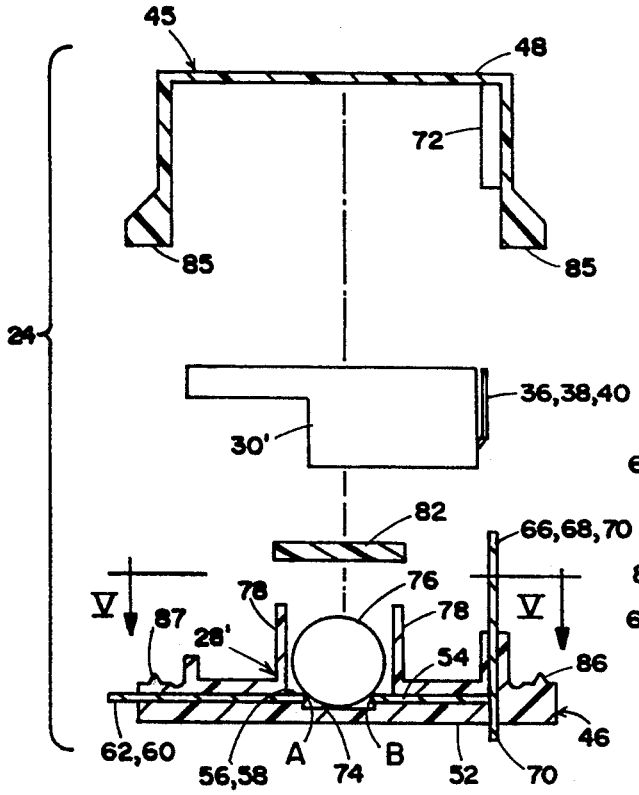
FIG. 4
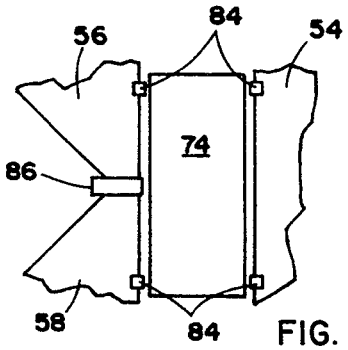
FIG. 6
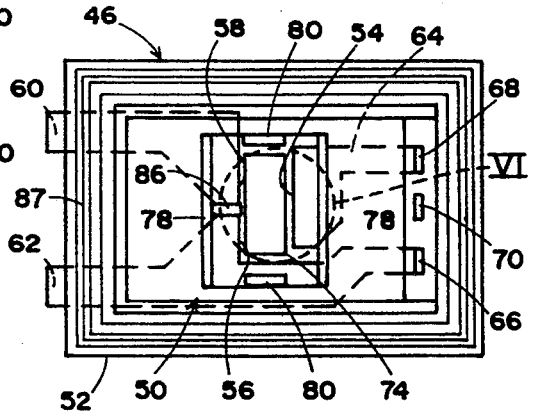
FIG. 5

INCLINATION SWITCH

BACKGROUND OF THE INVENTION

This invention relates generally to inclination switches, which respond to a change in inclination of an article to which the switch is mounted in order to actuate or deactuate a load. More particularly, the invention relates to an inclination switch for applications requiting long-term reliability notwithstanding repeated operation.

Inclination switches have many applications. In the automotive field, an inclination switch may be mounted to the lid of a trunk or engine compartment in order to actuate a light when the lid is raised and deactuate the light when the lid is lowered. Because, in such an application, the switch is actuated and deactuated with each opening of the trunk or engine compartment lid, industry standards require reliable operation for hundreds of thousands of actuation cycles.

Because of their reliability and freedom from moving mechanical contact components, which may experience erosion and welding from arcing, mercury switches have traditionally been used in such applications. However, with increased awareness of the environmental danger of mercury, such switches are typically prohibited in new product developments. As an alternative, switches have been proposed that incorporate a rolling ball positioned to selectively short a pair of contacts in response to inclination of the switch assembly. However, such devices tend to produce a noticeable rattle, or noise, upon actuation, which is considered a quality defect. Furthermore, the repeated breaking of current to the lamp eventually causes electrical erosion of the ball resulting in either intermittent malfunctioning due to contact stickiness or catastrophic malfunctioning by contact welding. Clearly such device is not a satisfactory substitution. Other designs, such as magnetically sensitive reed switches, in combination with gravity-positionable magnets, have been suggested but have proven to be unreliable and unduly expensive. Accordingly, there is a long-felt need for an inclination switch having the durability, reliability and quiet operation of mercury switches without their attendant environmental difficulties.

SUMMARY OF THE INVENTION

The present invention is embodied in an inclination responsive switch that is adapted to repetitive actuation and deactuation of a load. The switch includes a housing and a gravity responsive device that is adapted to produce an electrical signal having a first state when the housing is in a first inclination position and a second state when the housing is in a second inclination position. A switching device having an input and an output is provided with the output being adapted to switch an electrical load in response to the input. The input is responsive to a first state of a low-current electrical signal in order to cause the output to actuate the electrical load and to a second state of the low-current electrical signal in order to cause the output to deactuate the electrical load. The gravity switch is electrically connected with the input of the switching device in order to provide a low-current electrical signal of a first state to the input when the housing is in the first inclination position in order to actuate the load and to provide a low-current electrical signal of a second state to the input when the housing is in the second inclination position in order to deactuate the load.

In a first embodiment of the invention, the gravity sensing device includes a sphere made of an electrically conductive material and first and second elongated parallel contacts made of electrically conductive material and spaced apart on an electrically insulating portion of the housing less than the diameter of the sphere. The contacts and the insulating portion of the housing define a channel wherein the sphere can roll between a first position contacting the first and second contacts and a second position not contacting the first and second contacts in response to the housing moving from a first inclination position to a second inclination position. The first and second contacts are electrically connected with the input of the switching device and the sphere is juxtaposed with the channel in order to provide an electrical signal having one state to the input when the housing is in the first inclination position and to provide an electrical signal having a different state to the input when the housing is in the second inclination position.

In a second embodiment, the gravity sensing device includes a sphere made of electrically conductive material of a given diameter and first, second and third parallel planar electrical contacts made of electrically conductive material spaced apart on an electrically insulating portion of the housing less than the diameter of the sphere. An opening is defined in the middle one of the contacts that is larger than the diameter of the sphere whereby the sphere can move between a first position contacting the first and second contacts and a second position contacting the second and third contacts in response to the housing moving between a first inclination position and a second inclination position. The first, second and third electrical contacts are electrically connected with the input of the switching device and the sphere is juxtaposed with the opening in the middle one of the contacts in order to provide an electrical signal having a first state to the input when the housing is in the first inclination position and an electrical signal having a different state to the input when the housing is in a second inclination position.

The present invention overcomes the problems of the prior art by providing a satisfactory alternative to the environmentally unacceptable mercury inclination switches without the attendant drawbacks of other prior art substitutes. The present invention involves the mechanical switching of very low current signals and thereby substantially eliminates the electrical erosion and contact welding experience in other mechanical devices. As a result, a miniature switch is provided that is rugged and compact and does not emit objectional acoustical noise.

These and other objects, advantages and features of this invention will become apparent upon review of the following specification in conjunction with the drawings.

BRIEF DESCRIPTION OF THE DRAWINGS

FIG. 3 is a schematic diagram of an electrical circuit embodying the invention;

FIG. 4 is an exploded side view of an inclination switch assembly according to the invention;

FIG. 5 is a top plan view taken at V—V in FIG. 4 with the sphere removed for clarity;

FIG. 6 is an enlarged plan view of the portion designated VI in FIG. 5;

DESCRIPTION OF THE PREFERRED EMBODIMENT

Figure 1:
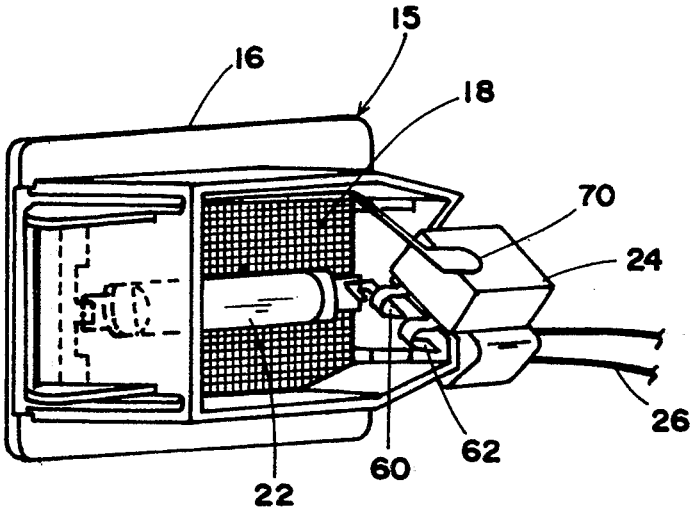
FIG. 1 is a perspective view taken from the side and rear of a compartment light assembly incorporating an inclination switch according to the invention.
Figure 2:
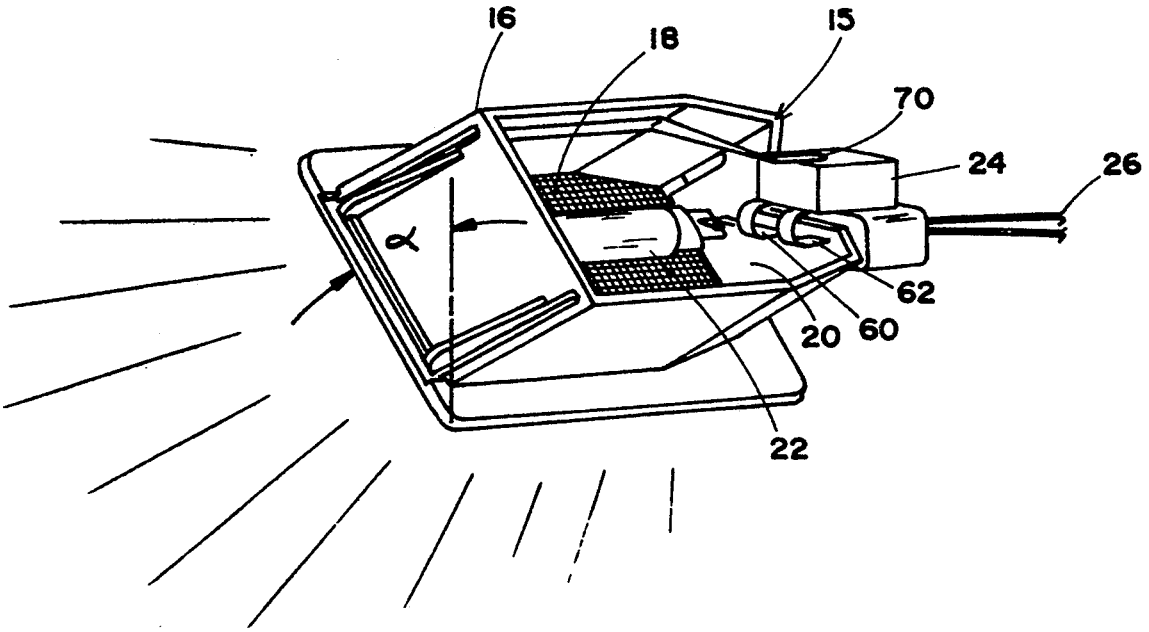
FIG. 2 is the same view as FIG. 1 illustrating actuation of the lamp in response to a different inclination position of the assembly.

Referring now specifically to the drawings, and the illustrative embodiment depicted therein, a lamp assembly 15 includes a housing 16 having a forwardly positioned lens 18 and a back 20 which is open for ventilation purposes (FIGS. 1 and 2). A lamp 22 is positioned within housing 16 behind lens 18 and is selectively actuated and deactuated by an inclination switch 24, which controls electrical energy supplied from supply leads 26. Because inclination switch 24 is mounted to lamp assembly housing 16, the inclination position of lamp assembly 15 determines whether the inclination switch is actuating lamp 22, as seen in FIG. 2, or deactuating the lamp as seen in FIG. 1. If lamp assembly 15 is for automotive applications, such as a compartment lamp mounted to the lid of a trunk or engine compartment, supply leads 26 will typically be supplied with battery voltage at nominal 12 volts DC. If the invention is applied to other purposes, such as an industrial application, or the like, supply leads 26 may be supplied with high voltage AC, such as 120 or 240 volts AC. Likewise, although inclination switch 24 is illustrated as intricately mounted with lamp assembly 15 for actuation with rotation of housing 16, switch 24 could be mounted separate from the lamp assembly, or controlled load, such that the load may be stationary or may move in unison with the inclination switch but in a different housing. FIG. 1 illustrates a compartment lamp assembly in a first inclination position in which lens 18 is substantially vertical and inclination switch 24 is deactuating lamp 18. In FIG. 2, housing 16 is rotated through angle alpha with lens 18 pivoted downwardly which causes inclination switch 24 to respond to the force of gravity by applying electrical energy from supply leads 26 in order to actuate lamp 22 as seen in FIG. 2.

Inclination switch 24 includes a gravity responsive contact assembly 28 and a switching device 30 that is actuated by the contacts of contact assembly 28 between a first state in which lamp 22 is actuated and a second state in which lamp 22 is deactuated (FIG. 3). This is accomplished by contact assembly 28 having one or more stationary contacts 32*a*, 32*b* and a movable contact 34, which is influenced by gravity whereby changing of the inclination position of inclination switch 24 causes movable contact 34 to make and break connection with stationary contact(s) 32*a*, 32*b* in order to change the state of an input 36 of switch device 30. In the illustrated embodiment, input 36 has a very high impedance such that switching device 30 may actuate lamp 22 with no appreciable current being switched by contact assembly 28. This is accomplished, in the illustrated embodiment, using an N-type metal oxide field effect transistor (MOSFET) having an insulated gate as input 36. Switching device 30 has a source terminal 30 that is connected with ground or chassis and a drain terminal 40 that is connected with one terminal of lamp 22. The other terminal 42 of lamp 22 is connected with a terminal of a battery 44. When movable contact 34 is moved into engagement with stationary contact 32*a* connected with terminal 42, the positive voltage applied to input 36 causes switching device 30 to produce a low impedance path between source 38 and drain 40 resulting in actuation of lamp 22. Movable contact 34 switches from engaging stationary contact 32*a* and into engagement with contact 32*b*, as a result of a change in the inclination position of inclination switch 24. Because contact 32*b* is connected with signal ground at 39, input 36 is grounded which causes switching device 30 to form an open circuit between source 38 and drain 40, which deactuates lamp 22.

Electrical arcing, which gives rise to electrical erosion and resulting contact welding and sticking, is a result of switching opening or breaking, a circuit carrying a current. Because the above-described switching operation occurs with virtually no current being switched by movable contact 34, movable contact 34 does not experience contact sticking or welding as a result of electrical erosion of the contact surfaces, brought about by repeated making and breaking of current carrying load circuits. Not only does this provide for a more reliable switch actuation over an extended period of time, the structure of contact assembly 28 may be made much smaller. This is because the current handling capability of a switch is proportional to the size of the switch contacts. By minimizing the amount of current carrying capacity required, the components of contact assembly 28 may be significantly reduced. As will be seen in more detail below, this allows the components of contact assembly 28 to be so small that any mechanical noise generated by movement of the contacts is attenuated to the point of being not noticeable.

Inclination switch 24 includes a housing 45 defined by a base portion 46 and a cover portion 48 (FIGS. 4–6). Contact assembly 28' is mounted to base portion 46 and a field effect transistor (FET) 30' is captured between cover portion 48 and base portion 46, as will be set forth in more detail below. Contact assembly 28' is made from stamped metallic electrical conductors 50 retained within an electrically insulating substrate 52 and a movable metallic sphere 76. Stamped circuit 50 forms a first electrical contact 54, and second and third electrical contacts 56 and 58, respectively. Contacts 56 and 58 are parallel to contact 54 and are in line with each other. Stamped circuit 50 additionally includes an electrical conductor 60 connected with contact 58, an electrical conductor 62 connected with contact 56 and an electrical conductor 64 connected with contact 54. Conductors 60 and 62 penetrate the wall of housing 45 on the left side, as viewed in FIGS. 4 and 5, in order to provide external connections to contacts 56 and 58. Conductor 62 additionally connects with a vertical conductor 66, which extends into an electrical contact connected with source terminal 38 of FET 30'. A conductor 64 is connected with contact 54 and connected with a vertical conductor 68, which extends into engagement with gate terminal 36 of FET 30'. Another vertical conductor 70 extends into electrical contact with drain terminal 40 of FET 30' and penetrates base portion 46 in order to provide external connection with drain terminal 40. The gate 36, source 38 and drain 40 terminals of FET 30' are spring-biased and, when switch 24 is fully assembled, capture conductors 64, 66 and 70 in grooves defined between ribs 72 formed in cover portion 48.

Substrate 52 has a depression 74 formed therein between contact 54 on one side and contacts 56 and 58 on another side so that electrically conductive sphere 76 may alternately make electrical connection between contacts 54 and 56 in one inclination position of housing 45 and between contacts 54 and 58 in a second inclination position of housing 45. As seen in FIG. 4, depression 74 allows point contact between sphere 76 and contacts 54, 56 and 58 at points A and B in FIG. 4. This point contact magnifies the effective mass of sphere 76 in making contact with contacts 54 56 and 58 By suitable selection of dimensions for sphere 76 and contact spacing, the effective mass of ball 76 may be increased four-fold in terms of applying contact pressure. A pair of stops 84 are formed contacts 54, 56 and 58 at opposite ends of depression 74 in order to allow an increase in the range of inclination angle to which the inclination switch may applied. An insulating partition 86 extends from substrate 52 between contacts 56 and 58 in order to prelude sphere 76 from shorting contacts 56 and 58 together. Substrate 52 includes a pair of insulating vertical walls 78 on opposite sides of contacts 54, 56 and 58 in order to capture sphere 76 and shock absorbing buffers 80 at opposite ends of depression 74. Inclination switch 24 may further include a pliable insulating pad 82 positioned between FET 30' and sphere 76 in order to cushion movement of the sphere as well as bias FET 30' firmly against cover portion 48.

After the components are assembled in the manner set forth above, a perimeter surface 85 cover portion 48 is welded to a perimeter surface 86 of lower housing portion 46 using conventional ultrasonic welding techniques. In the illustrated embodiment, housing portions 46 and 48 are made from a suitable electrically insulating polymeric material and the components of stamped circuit 50 are embedded in substrate 52 in order to provide dimensional stability and to impart mechanical strength on the assembly. In the illustrated embodiments, the internal components of the assembly are thoroughly cleaned prior to assembly and the housing portions are joined with an O-ring in order to provide a hermetically sealed assembly.

Figure 7:
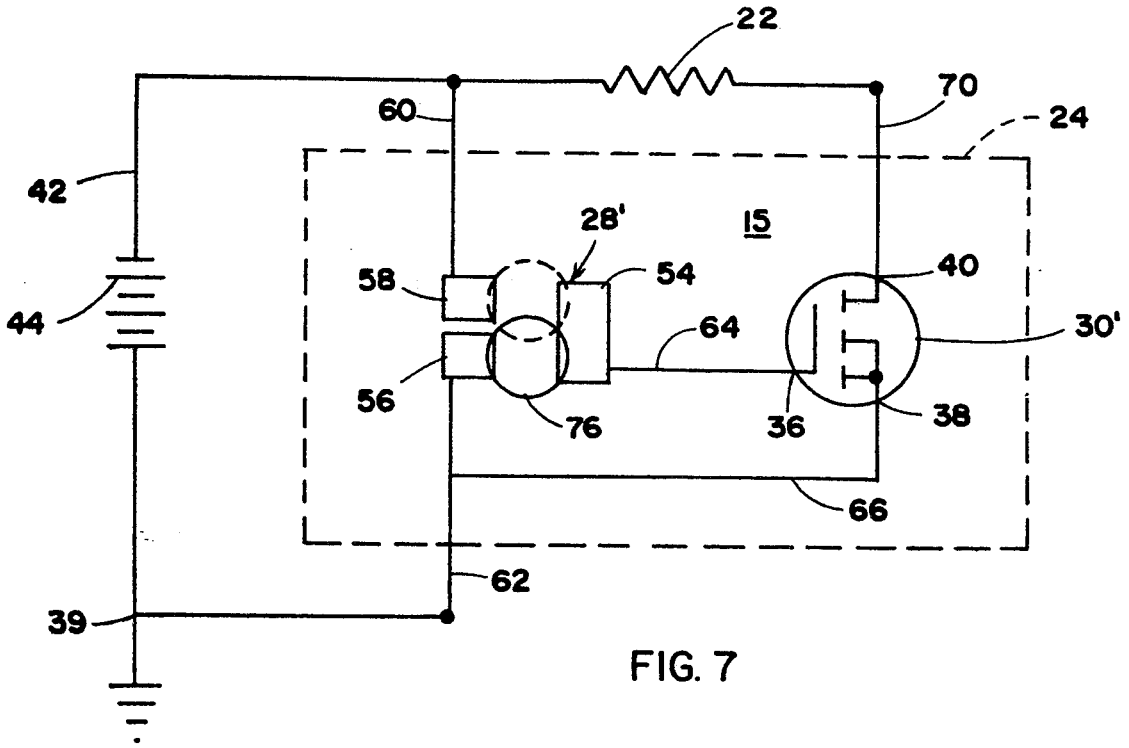
FIG. 7 is a schematic diagram of an electrical circuit of a detailed embodiment of the invention.

As the inclination position of switch 24 is changed, sphere 76 travels along the channel defined by contacts 56, 58 and 54 on opposite sides of depression 74 between a first position in which sphere 76 makes contact between contacts 56 and 54 and a second position, illustrated in phantom in FIG. 7, making electrical contact between contacts 58 and 54. When sphere 76 is making contact between contacts 54 and 58, battery voltage 44 is applied through conductor 60 and contact assembly 28' to conductor 64 connected with gate 36 of FET 30'. This causes a low impedance path between conductor 70 and conductor 66 through FET 30', resulting in actuation of lamp 22. When sphere 76 moves into the first position bridging contacts 56 and 54, the voltage from battery 44 is removed from gate 36 and signal ground 39 is applied through contact assembly 28' to gate 36. This causes FET 30' to become open-circuited, which deactuates lamps 22. As may be seen by reference to FIG. 7, inclination switch 24 requires three (3) electrical connections via conductors 60, 62 and 70 with external components of lamp assembly 15. These external connections may be conveniently provided through pressure contact between conductive pads on housing 45 and bus conductors arranged on housing 15, for ease of assembly as seen in FIGS. 1 and 2.

Figure 8:
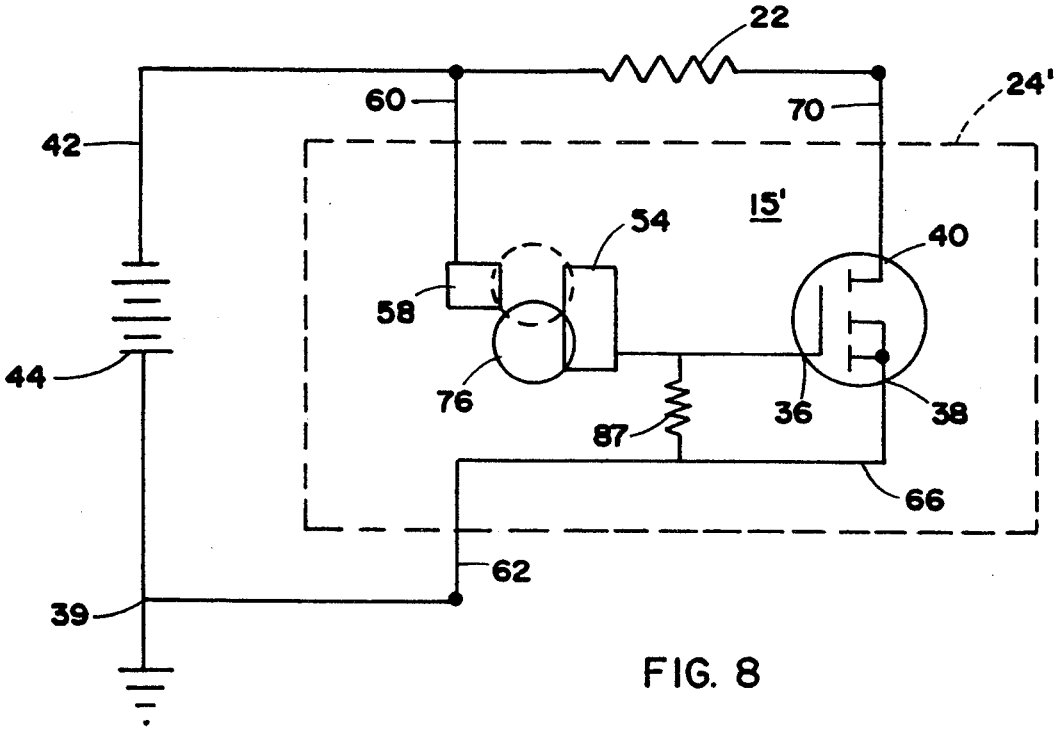
FIG. 8 is a schematic diagram of an electrical circuit of an alternative detailed embodiment of the invention.
Figure 10:
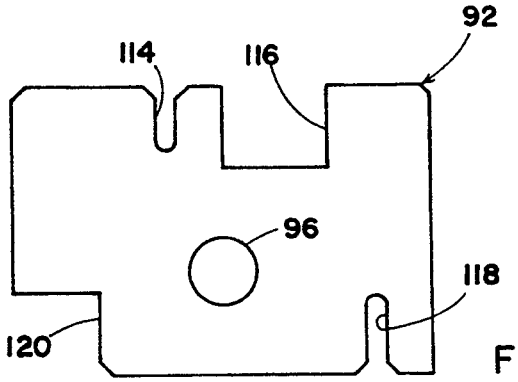
FIG. 10 is a sectional view taken along the lines X—X in FIG. 9.
Figure 11:
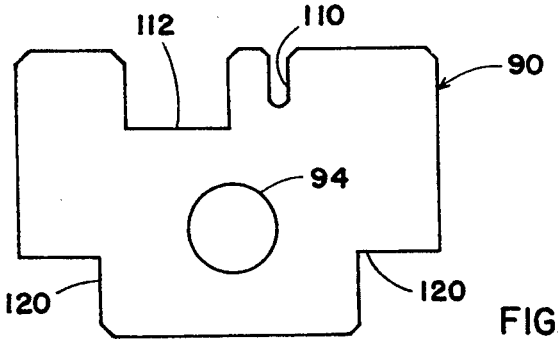
FIG. 11 is a sectional view taken along the lines XI—XI in FIG. 9.
Figure 12:
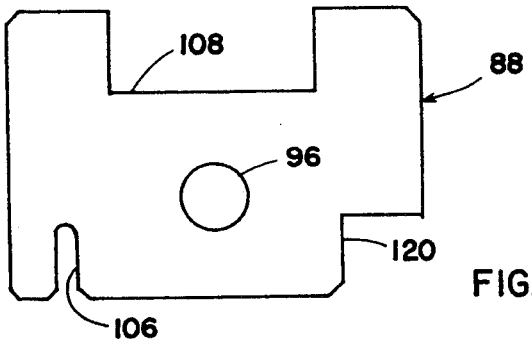
FIG. 12 is a sectional view taken along the lines XII—XII in FIG. 9.

In an alternative inclination switch 24', illustrated schematically in FIG. 8, contact 56 is replaced with a high impedance resistance device 88 which pulls gate 36 low whenever sphere 76 moves out of engagement between contacts 54 and 58. This not only eliminates the material of contact 56, but also the requirement for partition 86 between adjacent contacts. Operation of inclination switch 24' is otherwise the same as inclination switch 24.

A further alternative inclination switch 24'' is provided in which planar contact plates 88, 90 and 92 are positioned in parallel with each other and spaced apart a distance less than the diameter D of sphere 76 (FIGS. 9–13). Contact plate 90 has an opening 94 formed therein of a size that is greater than the diameter D of sphere 76, which is captured in opening 94 between plates 88 and 92. This allows sphere 76 to alternate between a first inclination position in which it is electrically connecting contact plates 88 and 90 and a second position in which it is electrically connecting contact plates 90 and 92. In the illustrated embodiment, each of the contact plates 88 and 92 has formed therein an opening 96 that is smaller than the diameter D of sphere 76. Openings 96 provide edge contact between sphere 76 and openings 94 and 96 in each of the two inclination positions. This magnifies the effective mass of sphere 76 in making contact with the sets of contact plates.

Figure 9:
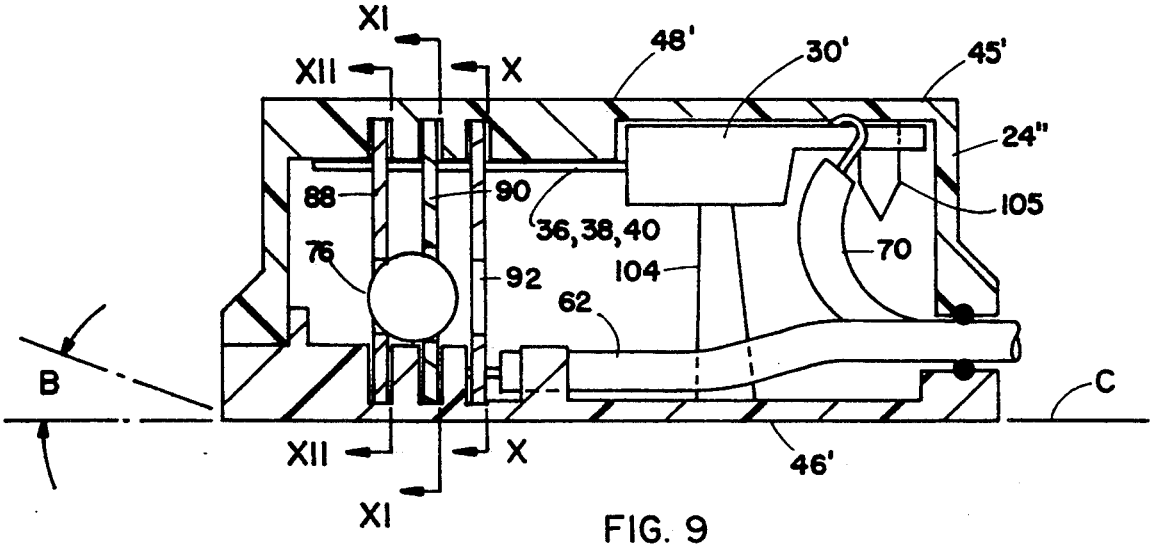
FIG. 9 is a sectional side elevation illustrating an alternative embodiment of an inclination switch assembly according to the invention.
Figure 13:
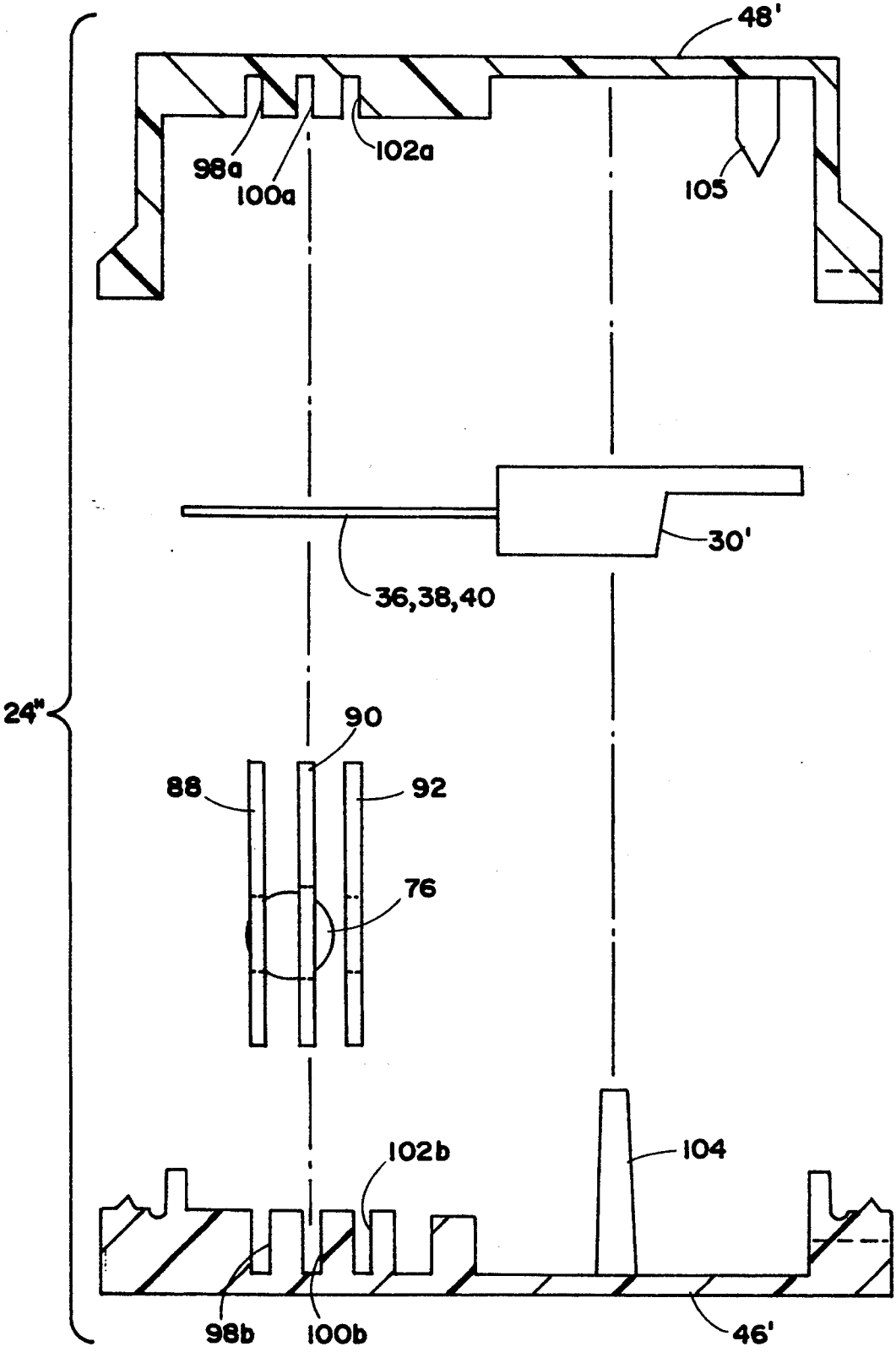
FIG. 13 is an exploded side elevation of the inclination switch assembly illustrated in FIG. 9.

As inclination switch 24'' is rotated through an angle beta, sphere 76 alternates positions. In a first inclination position, sphere 76 electrically contacts plates 88 and 90 and in a second inclination position contacts contact plates 90 and 92. An advantage of inclination switch 24'' is that it may be applied irrespective of the radial position of housing 45' around the inclination sensing axis C (FIG. 9). Although the openings 94 and 96 in contact plates 88, 90 and 92 are illustrated as circular, the openings may be other shapes, particularly if the housing 45' has a known radial position with respect to axis C.

Housing portions 46' and 48' of inclination switch 24'' include slots **98*a*, 98*b* in order to mount contact plate 88, slots 100*a*, 100*b* in order to mount contact plate 90 and slots 102*a*, 102*b* in order to mount contact plate 92. A support post 104 extending upwardly from housing base portion 46' biases switching device 30' into contact with cover portion 48'' when the housing portions are assembled. A stake 105 positions switching device 30' on cover portion 48''. As with the previously described embodiment, housing portions 46', 48'** are joined by ultrasonic welding techniques and may be sealed with an O-ring in order to hermetically seal the components.

Contact plate 88 includes a first cutout portion 106, which is sized to provide an interference fit with external conductor 60, and a second cutout portion 108, which is sized and positioned in order to avoid contact with terminals 36, 38 and 40 of switching device 30'. Contact plate 90 includes a first cutout portion 110, which is sized and positioned in order to create an interference fit with gate 36 of switching device 30', and a second cutout portion 112, which is sized and positioned in order to avoid contact with the other terminals of switching device 30'. Contact plate 92 includes a first cutout portion 114, which is sized and positioned for interference fit with source terminal 38 of switching device 30', a second cutout portion 116, which is sized and positioned in order to clear the remaining terminals of switching device 30', and a third cutout portion 118, which is sized in order to provide an interference fit with external conductor 62. Cutout portions 120 are provided in contact plates 88, 90 and 92, where required, in order to pass external conductors 60 and 62. External conductor 70 is directly connected with drain terminal 40 of switching device 30'.

In the illustrated embodiments, switching devices 30 and 30' are an industry standard Model T0-220AB field effect transistor, or MOSFET, which is capable of actuating lamp 22 with up to 100 amp current. A field effect transistor is used as switching device 30' in the illustrated embodiment because of the exceptionally low gate current of such device. However, bi-polar transistors, or other semi-conductor switching devices, such as SCRs (Silicone Control Rectifier) or triacs, may be used in particular applications.

An inclination switch, according to the present invention, is both compact and reliable. Because the sphere is not subject to damaging erosion from electrical arcing and the like, reliability throughout the large number of cycles required for automotive and industrial applications, is ensured. This also allows switching of the load to be initiated with a miniature sphere, eliminating the nuisance of perceivable audible rattling sounds. The unique housing and internal construction of the present invention further contributes to its reliability and ease of assembly, as well as to its miniature size.

Changes and modifications in the specifically described embodiments can be carried out without departing from the principles of the invention, which is intended to be limited only by the scope of the appended claims, as interpreted according to the principles of patent law including the Doctrine of Equivalents.

The embodiments of the invention in which an exclusive property or privilege is claimed are defined as follows:

1. An inclination responsive switch for repetitively actuating and deactuating a high-current load connected with a high-current output terminal of said switch, when said switch is connected with a source of electrical energy, comprising:

a housing;

a gravity responsive device in said housing having a low-current output terminal;

a semiconductor switching device having a low-current input terminal and a high-current output terminal;

said low-current output terminal being connected with said low-current input terminal, wherein electrical current produced by said gravity responsive device is supplied to said semiconductor switching device, and wherein electrical current produced by said semiconductor switching device is supplied to a load connected with said high current output signal; and wherein said gravity responsive device produces a low-current electrical signal on said low-current output terminal and said semiconductor switching device amplifies said low-current electrical signal to produce a high-current electrical signal, said low-current electrical signal having a first state when said housing is in a first inclination position in order to cause said switching device to supply a high current to actuate said electrical load, and said low-current electrical signal having a second state when said housing is in a second inclination position in order to cause said switching device to terminate said high current to deactuate said electrical load.

2. The inclination responsive switch in claim 1 wherein said gravity responsive device includes at least first and second contacts made of electrically conductive material, one of said first and second contacts being responsive to gravity in order to electrically connect the other of said first and second contacts with an electrical power source in one of said first and second inclination position in order to produce said low-current electrical signal and the other of said first and second contacts being electrically connected with said low-current terminal.

3. The inclination responsive switch in claim 2 including a third contact made of electrically conductive materials and connectable with one terminal of said electrical power source, wherein said one of said first and second contacts electrically interconnects said one terminal connected with said third contact with said other of said first and second contacts in said one of said first and second inclination positions.

4. The inclination responsive switch in claim 3 wherein said one of said first and second contacts is an electrically conductive sphere and wherein said third contact and said other of said first and second contacts forms a channel in which said sphere rolls in response to said housing changing between inclination positions.

5. The inclination responsive switch in claim 3 including a fourth contact made of electrically conductive material connectable with anther terminal of said electrical source, wherein said one of said first and second contacts electrically interconnects said other terminal connected with said fourth contact with said other of said first and second contacts in the other one of said first and second inclination positions.

6. The inclination responsive switch in claim 5 wherein said one of said first and second contacts is an electrically conductive sphere and wherein said third and fourth contacts and said other of said first and second contacts form a channel in which said sphere rolls in response to said housing changing between inclination positions.

7. The inclination responsive switch in claim 5 wherein said one of said first and second contacts is an electrically conductive sphere that is captured in an opening defined in said other of said first and second contacts and positioned between said third and fourth contacts.

8. The inclination responsive switch in claim 1 wherein said switching device is a field effect transistor having a gate which defines said low-current input terminal and a source-to-drain path which defines said high-current output terminal.

9. The inclination responsive switch in claim 8 wherein said switching device is enclosed by said housing.

10. The inclination responsive switch in claim 1 wherein said switching device is enclosed by said housing.

11. An inclination responsive switch for repetitively actuating and deactuating a high-current load connected with a high-current output terminal of said switch, when said switch is connected with a source of electrical energy, comprising:

a housing having an electrically insulating portion;

a sphere made of an electrically conductive material and having a defined diameter, said sphere captured between said insulating portion and another housing portion;

first and second contacts made of electrically conductive material and spaced apart on said electrically insulating portion of said housing less than said diameter of said sphere;

a semiconductor switching device having a low-current input terminal and a high-current output terminal;

one of said first and second contacts being electrically connected with said low-current input terminal and said sphere juxtaposed with said first and second contacts in order to electrically connect one terminal of a power source connected with the other of said first and second contacts with said low-current input when said housing is in a first inclination position and to isolate said source from said low-current input terminal when said housing is in a second inclination position; and wherein said semiconductor switching device amplifies current supplied to said low-current input terminal to actuate an electrical load connected with said high-current output terminal when said housing is in one of said inclination positions and to deactuate said electrical load when said housing is in said second inclination positions.

12. The inclination responsive switch in claim 11 wherein said housing includes a first housing section defining said insulated portion and a second housing section that mates with said first housing section in order to define an enclosure and capture said switching device between said first and second housing sections.

13. The inclination responsive switch in claim 12 further including electrical conductors mounted to said first housing section defining electrical interconnections between said contacts and said switching device and external electrical connections with said contacts and with said switching device.

14. The inclination responsive switch in claim 11 including a third electrical contact made of electrically conductive material and spaced apart on said electrically insulating portion of said housing from one of said first and second electrical contacts less than said diameter of said sphere, wherein said third electrical contact is connectable with another terminal of said power source and said sphere contacts said third electrical contact and said one of said first and second electrical contacts in said second inclination position in order to connect said one of said first and second electrical contacts with said another terminal of said power source connected with said third electrical contact in order to provide a low-current electrical signal having said second state to said switching device.

15. The inclination responsive switch in claim 11 wherein said housing is defined by an enclosure and said switching device is mounted within said housing enclosure.

16. The inclination responsive switch in claim 15 wherein said switching device is a field effect transistor having a gate defining said low-current input terminal and a source-to-drain path defining said high-current output terminal.

17. The inclination responsive switch in claim 11 wherein said switching device is a field effect transistor having a gate defining said low-current input terminal and a source-to-drain path defining said high-current output terminal.

18. An inclination responsive switch for repetitively actuating and deactuating a high-current load connected with a high-current output terminal of said switch, when said switch is connected with a source of electrical energy, comprising:

a housing having an electrically insulating portion;

a sphere made of an electrically conductive material and having a defined diameter, said sphere captured between said insulating portion and another housing portion;

first and second elongated parallel contacts made of electrically conductive material and spaced apart on said electrically insulating portion of said housing less than said diameter of said sphere, said contacts and said insulating portion of said housing defining a channel wherein said sphere can roll between a first position contacting said first and second contacts and a second position not contacting said first and second contacts in response to said housing moving from a first inclination position to a second inclination position;

a semiconductor switching device having a low-current input terminal and a high-current output terminal;

one of said first and second contacts electrically connected with said low-current input terminal and said sphere juxtaposed with said channel in order to electrically connect one terminal of a power source connected with the other of said first and second contacts with said low-current input terminal when said housing is in a first inclination position and to isolate said source from said low-current input terminal when said housing is in a second inclination position; and wherein said semiconductor switching device amplifies current supplied to said low-current input terminal to activate said electrical load connected with said high-current output terminal when said housing is in one of said positions and to deactuate said electrical load when said housing is in the other of said inclination positions.

19. The inclination responsive switch in claim 18 wherein said housing includes a first housing section defining said insulated portion and a second housing section that mates with said first housing section in order to define an enclosure and capture said switching device between said first and second housing sections.

20. The inclination responsive switch in claim 19 further including electrical conductors mounted to said first housing section defining electrical interconnections between said contacts and said switching device and external electrical connections with said contacts and with said switching device.

21. The inclination responsive switch in claim 18 including a third electrical contact connectable with the other terminal of said electrical power source, said third contact positioned parallel one of said first and second electrical contacts and in line with the other one of said first and second electrical contacts wherein said sphere contacts said third electrical contact and said one of said first and second electrical contacts in said second position in order to connect said other terminal of mid power source with said low-current electrical terminal.

22. The inclination responsive switch in claim 21 including an insulating partition between said third electrical contact and said other one of said first and second electrical contacts in order to avoid said sphere concurrently contacting both said third electrical contact and said other one of said first and second electrical contacts.

23. The inclination responsive switch in claim 22 including first and second electrically insulated stops at opposite ends of said channel to keep said sphere in said channel.

24. The inclination responsive switch in claim 18 including first and second insulated stops at opposite ends of said channel to keep said sphere in said channel.

25. The inclination responsive switch in claim 18 wherein said first and second electrical contacts are generally coplanar and wherein said channel is defined in said insulating portion of said housing in order to provide edge contact between said sphere and said first and second electrical contacts.

26. An inclination responsive switch for repetitively actuating and deactuating a high-current load connected with a high-current output terminal of said switch, when said switch is connected with a source of electrical energy, comprising:

a housing having an electrically insulating portion;

a sphere made of an electrically conductive material and having a diameter;

first, second and third parallel planar electrical contacts made of electrically conductive material and spaced apart on said electrically insulating portion of said housing less than said diameter of said sphere, means defining an opening in the middle one of said contacts that is larger than said diameter of said sphere, whereby said sphere can move between a first position contacting said first and second contacts and a second position contacting said second and third contacts in response to said housing moving from a first inclination position and a second inclination position;

a semiconductor switching device having a low-current input terminal and a high-current output terminal;

said second contact electrically connected with said low-current input terminal and said first and third contacts electrically connectable with respective first and second terminals of a power source, wherein said low-current input is electrically connected with a first terminal of said electrical source connected with said first contact when said housing is in one of said inclination positions and with a second terminal of said electrical source connected with said first contact when said housing is in the other of said inclination positions; and wherein said semiconductor switching device amplifies current supplied to said low-current input terminal to activate said electrical load when said housing is in one of said positions and to deactuate said electrical load when said housing is in the other of said inclination positions.

27. The inclination responsive switch in claim 26 further including means defining another opening in each of said first and third electrical contacts generally aligned with said opening in said second contact and each having a diameter less than said diameter of said sphere wherein said another opening captures said sphere while providing edge contact between said sphere and each of said first, second and third electrical contacts.

28. The inclination responsive switch in claim 26 wherein each of said first, second and third electrical contacts includes means defining an opening that provides an interference fit with one of an external lead and a terminal of said switching device.

29. The inclination responsive switch in claim 26 wherein said housing includes a first housing section defining said insulated portion and a second housing section that mates with said first housing section in order to define an enclosure and capture said switching device between said first and second housing sections.

* * * * *

UNITED STATES PATENT AND TRADEMARK OFFICE

CERTIFICATE OF CORRECTION

PATENT NO. : 5,365,116

DATED : November 15, 1994

INVENTOR(S) : Kurt L. Lohss

It is certified that error appears in the above-indentified patent and that said Letters Patent is hereby corrected as shown below:

Column 1, line 10:
"requiting" should be --requiring--.

Column 5, line 23:
After "54" insert --,--.

Column 5, line 23:
After "58" insert --.--.

Column 5, line 32:
"prelude" should be --preclude--.

Column 5, line 42:
After "85" insert --of--.

UNITED STATES PATENT AND TRADEMARK OFFICE

CERTIFICATE OF CORRECTION

PATENT NO. : 5,365,116 Page 2 of 2

DATED : November 15, 1994

INVENTOR(S) : Kurt L. Lohss

It is certified that error appears in the above-indentified patent and that said Letters Patent is hereby corrected as shown below:

Column 6, line 56:
" 48'' " should be --48'--.

Column 6, line 58:
" 48'' " should be --48'--.

Column 8, line 18:
"position" should be --positions--.

Column 8, line 38:
"anther" should be --another--.

Column 11, line 1:
"mid" should be --said--.

Signed and Sealed this

Twelfth Day of December, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,365,116
DATED : November 15, 1994
INVENTOR(S) : Kurt L. Lohss

It is certified that error appears in the above-indentified patent and that said Letters Patent is hereby corrected as shown below:

Column 5, line 43:
"86" should be --87--.

Signed and Sealed this

Sixteenth Day of April, 1996

Bruce Lehman

*Attest:*

BRUCE LEHMAN

*Attesting Officer*

*Commissioner of Patents and Trademarks*